US008841587B2

(12) United States Patent
Tsuruya et al.

(10) Patent No.: US 8,841,587 B2
(45) **Date of Patent: *Sep. 23, 2014**

(54) IMAGE HEATING APPARATUS AND HEATER USED IN THE APPARATUS

(71) Applicant: Canon Kabushiki Kaisha, Tokyo (JP)

(72) Inventors: Takaaki Tsuruya, Mishima (JP); Hiroyuki Sakakibara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/046,364

(22) Filed: Oct. 4, 2013

(65) Prior Publication Data

US 2014/0037348 A1 Feb. 6, 2014

Related U.S. Application Data

(62) Division of application No. 13/484,978, filed on May 31, 2012, now Pat. No. 8,592,726.

(30) Foreign Application Priority Data

Jun. 2, 2011 (JP) ..... 2011-124161

(51) Int. Cl.

| | |
|---|---|
| ***G03G 15/20*** | (2006.01) |
| ***H05B 3/02*** | (2006.01) |
| ***H05B 3/10*** | (2006.01) |
| ***H05B 3/16*** | (2006.01) |
| ***H05B 3/26*** | (2006.01) |

(52) U.S. Cl.

CPC ..... *G03G 15/2085* (2013.01); *G03G 15/2042* (2013.01)

USPC ..... 219/216; 219/505; 219/539; 219/541; 399/329

(58) Field of Classification Search

None

See application file for complete search history.

(56) References Cited

U.S. PATENT DOCUMENTS

| | | | | |
|---|---|---|---|---|
| 5,525,775 | A | 6/1996 | Setoriyama et al. | |
| 6,084,208 | A * | 7/2000 | Okuda et al. | 219/216 |
| 6,456,819 | B1 * | 9/2002 | Abe et al. | 399/329 |
| 7,321,746 | B2 | 1/2008 | Sakakibara et al. | |
| 7,974,563 | B2 | 7/2011 | Sakai et al. | |
| 8,005,413 | B2 | 8/2011 | Sakakibara et al. | |
| 8,126,383 | B2 * | 2/2012 | Kagawa | 399/329 |

(Continued)

FOREIGN PATENT DOCUMENTS

| | | |
|---|---|---|
| JP | 4-44075 A | 2/1992 |
| JP | 2008-166096 A | 7/2006 |

(Continued)

*Primary Examiner* — Joseph M Pelham

(74) *Attorney, Agent, or Firm* — Fitzpatrick, Cella, Harper & Scinto

(57) ABSTRACT

An image heating apparatus includes: an endless belt; a heater, contacted to a surface of the endless belt, provided so that a longitudinal direction thereof is parallel to a generating line direction of the endless belt; and a pressing member for forming a nip together with the endless belt. The heater includes: an elongated substrate; a first heat generating line, provided on the substrate along a longitudinal direction of the substrate, including first heat-generating resistors having a negative temperature coefficient of resistance and being electrically connected in series; and a second heat generating line, provided on the substrate along the longitudinal direction of the substrate, electrically connected to the first heat generating line in parallel. The second heat generating line includes a plurality of second heat-generating resistors having the negative temperature coefficient of resistance and being electrically connected in series.

18 Claims, 11 Drawing Sheets

(56) References Cited

U.S. PATENT DOCUMENTS

| | | | | |
|---|---|---|---|---|
| 8,150,304 | B2 * | 4/2012 | Kagawa et al. | 399/329 |
| 8,224,223 | B2 | 7/2012 | Sakakibara et al. | |
| 8,295,753 | B2 * | 10/2012 | Kagawa | 399/329 |
| 8,471,178 | B2 * | 6/2013 | Taniguchi et al. | 219/216 |
| 2009/0230114 | A1 * | 9/2009 | Taniguchi et al. | 219/216 |
| 2011/0091252 | A1 | 4/2011 | Sekihara et al. | |
| 2011/0217092 | A1 | 9/2011 | Sekihara et al. | |
| 2011/0274458 | A1 | 11/2011 | Hijikata et al. | |
| 2012/0014726 | A1 | 1/2012 | Sekihara et al. | |
| 2012/0121306 | A1 | 5/2012 | Shimura et al. | |

FOREIGN PATENT DOCUMENTS

| | | | | |
|---|---|---|---|---|
| JP | 2008166096 | A | * | 7/2008 |
| JP | 2009-244867 | A | | 10/2009 |
| JP | 2010-002857 | A | | 1/2010 |
| JP | 2011-060657 | A | | 3/2011 |

* cited by examiner

IMAGE HEATING APPARATUS AND HEATER USED IN THE APPARATUS

This application is a Divisional Application of allowed application Ser. No. 13/484,978 filed on May 31, 2012.

FIELD OF THE INVENTION AND RELATED ART

The present invention relates to a heater and an apparatus using the heater and particularly relates to an image heating apparatus used in an image forming apparatus such as a copying machine, a printer or a facsimile machine. As the image heating apparatus, a fixing device (apparatus) for fixing an unfixed image on a recording material and a glossiness-improving heating device (apparatus) for improving the glossiness of an image by heating the image fixed on the recording material are cited.

In an electrophotographic copying machine or printer, the fixing device for heat-fixing a toner image formed on the recording material is mounted and as one of heating types of the fixing device, there is a film-heating type of heater. In the film-heating type of heater, a ceramic heater is provided on an inner surface of a cylindrical film (fixing film) formed principally of a heat-resistant material or metal. A pressing roller is provided opposed to the ceramic heater via the fixing film to press the fixing film between itself and the ceramic heater. Further, the fixing film and the recording material intimately contact each other to supply the heat of the ceramic heater to the recording material. In the image forming apparatus in which the fixing device of the film-heating type is mounted, in the case where paper (small-sized paper) with a width somewhat smaller than that of a maximum-sized paper passable through the fixing device is passed through the fixing device, a so-called non-sheet-passing-portion temperature rise is liable to occur. That is, with respect to the longitudinal direction perpendicular to a paper-conveyance direction of the fixing device, a phenomenon occurs in which a temperature of a non-sheet-passing portion through which the paper does not pass is gradually increased. When the non-sheet-passing-portion temperature is excessively increased, deterioration of parts in the fixing device is accelerated, so that there is a possibility of breakage of the parts. Further, when the paper with a width larger than that of the small-sized paper is passed through the fixing device in a state in which the non-sheet-passing-portion temperature rise occurs, in a paper-end region (the non-sheet-passing portion during sheet passing of the small-sized paper), high-temperature offset is liable to occur.

As one of the methods of suppressing the non-sheet-passing-portion temperature rise, a method in which a material with a negative temperature coefficient (NTC) characteristic (i.e., having a negative temperature coefficient of resistance (TCR) value at which a resistance value is lowered when the temperature is increased) is used as a heat-generating resistor on a ceramic heater substrate has been known. Here, when a method such that the heat-generating resistor with the NTC characteristic is formed in a linear hand-like shape on the ceramic substrate to supply electric power with respect to the longitudinal direction is employed, in many cases, it is difficult to obtain the resistance in a range in which the resistance can be used for a commercial power source.

Therefore, a method has been developed in which the heat-generating resistor with the NTC characteristic is divided into the three or more portions with respect to the longitudinal direction of the substrate to provide a heat-generating-resistor pattern such that the divided heat-generating resistors are electrically connected in series to supply electric power so that a current passes through the heat-generating resistors with respect to the paper-conveyance direction. As a result, the heat-generating resistors can be used in a low resistance state.

However, in recent years, with speeding up of the operation of the image forming apparatus, these image heating apparatuses have not adequately suppressed the non-sheet-passing-portion temperature rise, so that it is desired to provide a heater and an image heating apparatus whose resistors have a resistance value that is in the range usable for commercial electric power and that suppresses the non-sheet-passing-portion temperature rise.

SUMMARY OF THE INVENTION

A principal object of the present invention is to provide a heater and an image heating apparatus which are capable of suppressing the non-sheet-passing-portion temperature rise at a low cost and with a simple constitution.

According to an aspect of the present invention, there is provided an image heating apparatus comprising: an endless belt; a heater contacted to an inner surface of the endless belt, wherein the heater is provided so that a longitudinal direction thereof is parallel to a generating line direction of the endless belt; and a pressing member for forming a nip, in which a recording material carrying thereon an image is to be nip-conveyed, together with the endless belt. The heater comprises: an elongated substrate; a first heat generating line provided on the substrate along a longitudinal direction of the substrate, wherein the first heat generating line includes a plurality of first heat-generating resistors having a negative temperature coefficient of resistance and being electrically connected in series; and a second heat generating line, provided on the substrate along the longitudinal direction of the substrate, electrically connected to the first heat generating line in parallel, wherein the second heat generating line includes a plurality of second heat-generating resistors having the negative temperature coefficient of resistance and being electrically connected in series.

According to another aspect of the present invention, there is provided a heater for use with an image heating apparatus comprising: an elongated substrate; a first heat generating line provided on the substrate along a longitudinal direction of the substrate, wherein the first heat generating line includes a plurality of first heat-generating resistors having a negative temperature coefficient of resistance and being electrically connected in series; and a second heat generating line, provided on the substrate along the longitudinal direction of the substrate, electrically connected to the first heat generating line in parallel, wherein the second heat generating line includes a plurality of second heat-generating resistors having the negative temperature coefficient of resistance and being electrically connected in series.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

The First Embodiment of the present invention will be described below with reference to the drawings.

(1) Image Forming Apparatus

Figure 2:
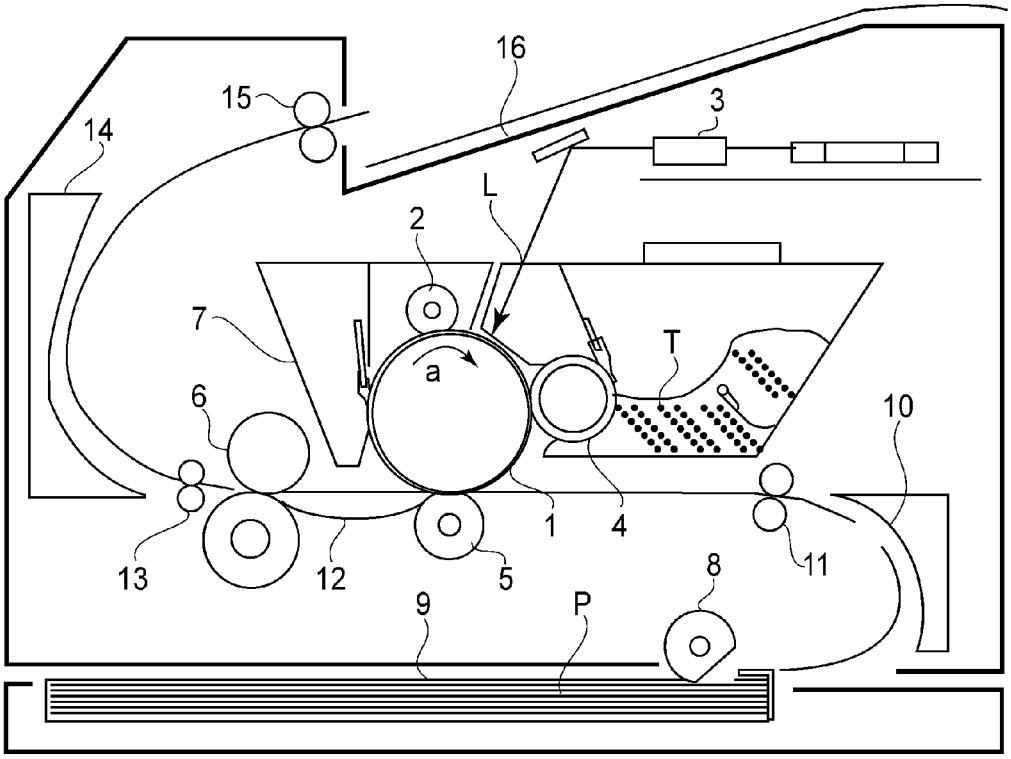
FIG. 2 is a schematic illustration of an image forming apparatus in which an image heating apparatus in the First Embodiment is mounted.

FIG. 2 is a schematic illustration of an example of an image forming apparatus in which an image heating apparatus in this embodiment is mounted as a fixing device (apparatus). The image forming apparatus in this embodiment is a laser beam printer using a transfer-type electrophotographic process. A rotation-drum-type electrophotographic photosensitive member (photosensitive drum) 1 as an image bearing member is rotated and driven in the clockwise direction of an arrow a at a predetermined peripheral speed (process speed). The photosensitive drum 1 is constituted by forming a layer of a photosensitive material such as OPC, amorphous Se or amorphous Si on an outer peripheral surface of an electroconductive substrate of aluminum or nickel or the like in a cylindrical (drum-like) shape.

The photosensitive drum 1 is, during its rotation process, electrically charged uniformly to a predetermined polarity and potential by a charging roller 2. Then, the uniformly charged surface of the photosensitive drum 1 is subjected to scanning exposure L to a laser beam, which is modulation-controlled (ON/OFF controlled) depending on image information outputted from a laser beam scanner 3, so that an electrostatic latent image of intended image information is formed on the photosensitive drum surface. The thus-formed latent image is developed with a toner T by a developing device 4 to be visualized. As a developing method, a jumping developing method, a two-component developing method or an FEED developing method or the like is used in many cases in combination with the image exposure and reversal development.

On the other hand, sheets of a recording material P accommodated in a sheet feeding cassette 9 are fed one by one by driving of a driving roller 8 and pass through a sheet path including a guide 10 and a registration roller 11. Then, the recording material P is sent to a transfer nip, which is a press-contact portion between the photosensitive drum 1 and a transfer roller 5, with predetermined control timing, so that the toner images are successively transferred from the surface of the photosensitive drum 1 onto the surface of the sent recording material P. The recording material P coming out of the transfer nip is separated from the surface of the photosensitive drum 1 and is guided into a fixing device 6 as the image heating apparatus by a conveying device 12 to be subjected to a thermal-fixing process of the toner image.

The fixing device 6 will be described specifically in (2) below. The recording material P coming out of the fixing device 6 passes through a sheet path including a conveying roller 13, a guide 14 and a sheet discharging roller 15 and then is printed out on a sheet discharge tray 16. Further, the photosensitive drum surface, after the separation of the recording material P, is subjected to removal of a deposited contamination, such as transfer residual toner, by a cleaning device 7, thus being cleaned and then being repetitively subjected to image formation.

In this embodiment, an image forming apparatus, which has a process speed of 300 mm/sec and which forms images on A4-sized paper, is used. The toner T is principally formed of styrene-acrylic resin and is used in the form of a mixture further containing, as desired, a charge control component, a magnetic material, silica and the like, which are internally or externally added.

(2) First Device (Image Heating Apparatus)

Figure 3:
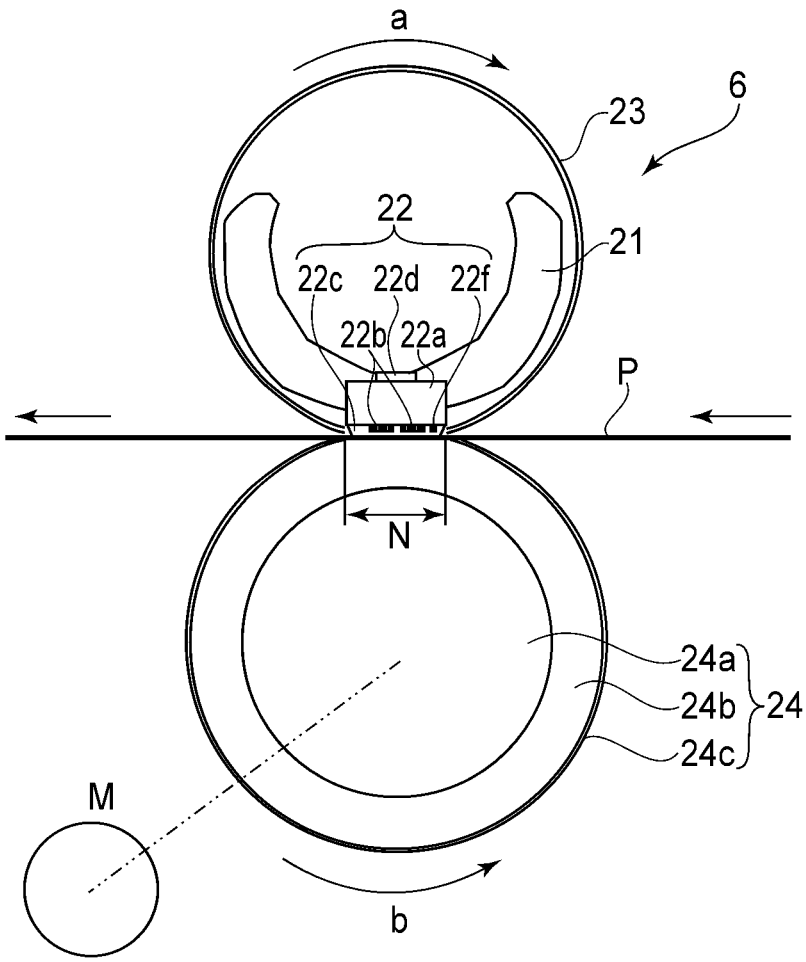
FIG. 3 is a schematic illustration of a fixing device as the image heating apparatus in the First Embodiment.

FIG. 3 is a schematic structural illustration of the fixing device 6 as the image heating apparatus in this embodiment. The fixing device 6 is of a film-heating type and includes a film 23 as a cylindrical flexible member, a heater 22 contacting the inner surface of the film 23, and a pressing roller (pressing member) 24 for forming a fixing nip between itself and the film 23 to which the heater 22 is contacted.

That is, the film 23 contacts and slides on the heater 22 at one surface and contacts the recording material (recording paper) as a material to be heated at the other surface, so that the film 23 and the recording material are nip-conveyed together in the nip formed between the film 23 and the pressing roller 24. The pressing roller 24 receives power from a motor M and is rotated in an arrow b direction. By rotating the pressing rotate 24 so that the recording material intimately contacts the film 23, the film 23 is rotated by the rotation of the pressing roller 24.

The heater 22 is held by a holding member 21 of a heat-resistant resin material. The holding member 21 also has the function of a guide for guiding the rotation of the film 23. The holding member 21 is a mold of the heat-resistant resin material such as PPD (polyphenylene sulfide) or a liquid crystal polymer. The heater 22 includes an elongated heater substrate 22*a*, which has an electrically insulating property and a plurality of heat-generating resistors 22*b*, which are formed on the substrate 22*a*, which have a negative resistance temperature characteristic, and which generate heat by energization. Further, the heater 22 includes an electroconductive pattern 22*f* and a surface protective layer 22*c*, of an insulating material (glass in this embodiment), for covering the heat-generating resistor 22*b* and the electroconductive pattern 22*f*.

As the heat-generating resistor 22*b*, three or more heat-generating resistors are electrically connected in series with respect to a longitudinal direction of the substrate 22*a*. An electrode 22*a* (FIG. 1) contacts a connector for energization and is formed of the same material as that for the electroconductive pattern 22*f*. This electrode 22*e* is a common electrode for the heat-generating resistors adjacent to each other with respect to a widthwise direction of the substrate 22*a*.

To a back surface of the heater substrate 22*a*, a temperature detecting element 22*d*, such as a thermistor, is contacted. Depending on a detection temperature of the temperature detecting element 22*d*, the energization to the heat-generating resistors 22*b* is controlled. In FIG. 3, the thickness of the film 23 may preferably be about 20 μm or more to about 60 μm or less in order to ensure a good heat transfer property.

The film 23 is a single-layer film of a resin such as PTFE (polytetrafluoroethylene), PFA (polytetrafluoroethylene-perfluoroalkylvinyl ether) or PPS.

Alternatively, the film 23 is a composite-layer film prepared by forming a parting layer of PTFE, PFA, FEP (perfluoroethylene/propylene) or the like on the surface of a base film of a resin such as polyimide, polyamideimide, PEEK (polyether ether ketone) or PES (polyether sulfone).

The pressing roller 24 includes a metal core 24*a* of iron or aluminum, an elastic layer 24*b* of an elastic member of silicone rubber or the like, and a parting layer 24*c* of a fluorine-containing resin such as PFA.

The toner image on the recording material P is heat-fixed on the recording material by being nip-conveyed in the nip N. The recording material P passing through the nip N is conveyed to the sheet discharge tray 16.

(2) Heater 22

Figure 4:
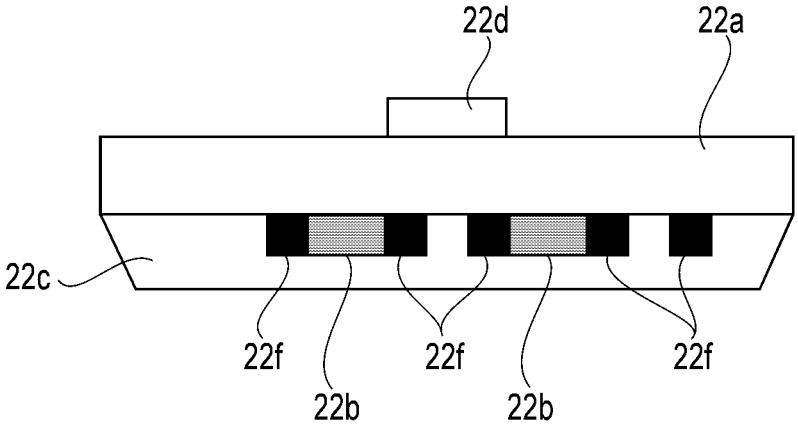
FIG. 4 is a sectional view of the heater in the First Embodiment.

Next, a constituent material and manufacturing method and the like of the heater 22 will be described. FIG. 4 is a sectional view of the heater 22 in the fixing device 6. The material for the heater 22 is ceramics such as alumina and aluminum nitride. The material constituting the heat-generating resistors 22*b* varies depending on an electroconductivity-imparting component, such as ruthenium oxide ($RuO_2$) or graphite, as a base material.

First, ruthenium oxide ($RuO_2$) will be described. A paste of a mixture of (A) an electroconductive component containing ruthenium oxide, (B) a glass component, (C) a TCR adjusting component and (D) an organic binder component is printed on the substrate 22*a* and then is sintered. When the paste is sintered, the organic binder component (D) is removed by the sintering and other components (A) to (C) remain on the substrate 22*a*. Accordingly, on the heater substrate 22*a* after the sintering, the heat-generating resistors 22*b* containing the ruthenium oxide-containing electroconductive component, the TCR adjusting component and the glass component are formed.

(A): Fine powder of ruthenium oxide ($RuO_2$) alone or a mixture of ruthenium oxide ($RuO_2$) and silver/palladium (Ag/Pd)

(B): Glass powder (glass component or inorganic binder component)

(C): TCR adjusting component (D): Organic binder component

Here, the ruthenium oxide ($RuO_2$) (A) may desirably have a particle size of 1 μm or less, more desirably be 0.2 μm or less. The ruthenium oxide ($RuO_2$) is a non-metal-based electroconductive component and is a material having a sufficiently low resistance as a specific resistance although the value is not lower than that of a metal-based electroconductive component, thus being suitable for a resistive paste material. For example, the specific resistance of silver which is the metal is $1.62\times10^{-6}$ Ωcm and on the other hand, the specific resistance of ruthenium oxide is $4\times10^{-5}$ Ωcm.

Generally, the metal-based electroconductive component is adjusted to have a proper sheet-resistance value for the heat-generating resistor by being mixed with various binder components to form an alloy. However, even when the metal-based electroconductive component is used as the material for the heat generating resistor, the TCR characteristic is not adjusted to a negative characteristic. For example, the TCR is not adjusted to a negative characteristic. For example, the TCR of silver (Ag) alone was about +3000 ppm (parts per million)/° C., and a minimum TCR of the alloys of silver/palladium (Ag/Pd) was about +100 ppm/° C.

On the other hand, although the TCR of ruthenium oxide ($RuO_2$) alone is about +3000 ppm/° C., by a combination thereof with the TCR adjusting component described below, the TCR of a resultant thick-film resistive paste is shifted to the negative side, so that it becomes also possible to provide the NTC characteristic. That is, as the material for the heat-generating resistor of the heater mounted in the image heating apparatus of the film-heating type, ruthenium oxide ($RuO_2$) is very suitable for achieving the NTC characteristic while satisfying a required sheet resistance.

The TCR adjusting component (C) is at least one of manganese oxide ($MnO_2$), niobium oxide ($Nb_2O_5$), titanium oxide ($TiO_2$) and antimony oxide ($Sb_2O_2$), and is particularly important for adjusting the TCR characteristic to the negative characteristic (NTC characteristic). The TCR adjusting component may preferably have a particle size of 10 μm or less, and more preferably 5 μm or less. The TCR adjusting component does not act on silver/palladium (Ag/Pd) but acts on ruthenium oxide ($RuO_2$), thus having an effect of shifting the TCR to the negative side.

Incidentally, the heat-generating resistor 22*b* of the electroconductive component principally containing ruthenium oxide ($RuO_2$) has a tendency that the sheet-resistance value thereof is higher than that of the heat-generating resistor 22*b* of the electroconductive component containing ruthenium oxide ($RuO_2$) mixed with silver/palladium (Ag/Pd). These materials may appropriately selected or adjusted in consideration of the total resistance or the like of the heat-generating resistor 22*b* necessary to design the heater 22.

Incidentally, in the alloy of silver/palladium (Ag/Pd), the TCR varies depending on a mixing ratio between silver and palladium. When silver (Ag) is exceeds 95 wt. % and palladium (Pd) is less than 5 wt. %, the TCR becomes an excessively large positive value (PTC (positive temperature coefficient)). Therefore, even in the case where ruthenium oxide ($RuO_2$) and the TCR adjusting component are added to the alloy of silver/palladium (Ag/Pd), when the alloy of silver/palladium (Ag/Pd) has the positively large TCR, it becomes difficult to obtain a desired NTC characteristic.

Therefore, in order to suppress the PTC of the silver/palladium alloy at a small level, the content of palladium may preferably be 5 wt. % or more and 60 wt. % or less. However, palladium (Pd) is very expensive and therefore, its content may more preferably be 5 wt. % or more and 40 wt. % or less. Further, as the material for the heat-generating resistor 22*b*, it is also possible to add a material, other than the above-described components (A) to (D), in a slight amount in which a characteristic in the present invention is not impaired.

Further, in a range in which the characteristic in the present invention is not impaired, a ratio and specific material of the glass power (C) may appropriately be selected. The content of the glass powder in the resistive paste may preferably be 5 wt. % or more and 70 wt. % or less, but when the content of the glass powder is large, the resistance value becomes large.

Therefore, the content of the glass powder may more preferably be 30 wt. % or less. As the resistive paste material showing the NTC characteristic other than ruthenium oxide, graphite is also suitable. In general, graphite itself shows the NTC characteristic and therefore the NCT characteristic can be realized without using the TCR adjusting component as in the case of ruthenium oxide.

The electric power supplying electrode 22*e* and the electroconductive pattern 22*f* are formed by screen printing using electroconductive paste principally containing silver (Ag), platinum (Pt), gold (Au), silver/platinum (Ag/Pt), silver/palladium (Ag/Pd) and the like. The electric power supply electrode 22*e* and the electroconductive pattern 22*f* are provided for the purpose of supplying the electric power to the heat-generating resistors 22*b* and therefore the resistances thereof are set at values sufficiently lower than the resistance of the heat-generating resistors 22*b*. The overcoat layer (surface protective layer) 22*c* is formed on the heat-generating resistors 22*b* for the purpose of ensuring an electrically insulating property between the heat-generating resistors 22*b* and the film 23 and ensuring a sliding property between the heater 22 and the film 23.

(4) Manufacturing Method

Next, a manufacturing method of the heater 22 will be described. First, the resistive paste is screen-printed on the substrate 22*a* to form a coating film. Thereafter, the coating film is dried and sintered in a sintering furnace at a sintering peak temperature of about 850° C. for 10 min (about 40 mm as elapsed time of sintering furnace). By this sintering, the binders contained in the paste is evaporated and diffused. Then, the glass component as the inorganic binder component is melted, so that only manganese oxide and ruthenium oxide ($RuO_2$) or the mixture of manganese oxide and ruthenium oxide ($RuO_2$) with silver/palladium (Ag/Pd) is thermally fixed on the surface of the substrate 22*a* to form the heat-generating resistors 22*b*.

Next, on the substrate 22*a*, the above-described electroconductive paste is applied by the screen printing and is dried and thereafter is sintered similarly as in the case of the resistance paste to form the electric power supplying electrode 22*e* and the electroconductive pattern 22*f*. In this embodiment, the heat-generating resistors 22*b* are formed and then the electric power supplying electrode 22*e* and the electroconductive pattern 22*f* are formed but this order may also be reversed. Further, there is no problem that these members 22*b*, 22*e* and 22*f* may appropriately be formed superposedly as desired.

Thereafter, the overcoat layer 22*c* is formed by using, e.g., glass paste prepared by kneading, in an organic solvent, glass powder of silicon oxide ($SiO_2$)-zinc oxide (ZnO)-aluminum oxide ($Al_2O_3$) type principally containing silicon oxide ($SiO_2$) together with ethyl cellulose (organic binder component). That is, this glass paste is continuously applied onto the surface portion with no spacing to form a coating film.

Then, this coating film is dried and thereafter sintered in the sintering furnace at the sintering peak temperature of about 850° C. for about 10 mm (about 40 min as elapsed time of the sintering furnace) to obtain a 15-100 μm thick overcoat layer of the glass material. The coating may also be appropriately repeated as desired. In this embodiment, as the overcoat layer, an about 50 μm-thick heat-resistant glass layer was used.

Next, the case where the paste material using graphite as the principle electroconductive component is used will be described. First, on the substrate 22*a*, the electric power supplying electrode 22*e* and the electroconductive pattern 22*f* are screen-printed to form a coating film. Thereafter, the coating film is dried and then sintered in the sintering furnace at the sintering peak temperature of about 850° C. for about 10 min (about 40 min as elapsed time of the sintering furnace). Then, the resistive paste principally containing graphite for providing electroconductivity is screen-printed, dried and sintered similarly as in the case of the elastic power supplying electrode 22*e* and the electroconductive pattern 22*f* to form the heat-generating resistors 22*b*.

At about 700° C., surface oxidation of graphite is started, so that the sintering temperature was about 600° C. Thereafter, the overcoat layer 22*c* is formed by the screen printing, followed by drying and sintering. In view of the heat resistance of graphite, as the material for the overcoat layer 22*c*, glass capable of being sintered at 400-500° C. may be selected.

(Comparison of Arrangement of Heat-Generating Resistors)

Next, with respect to arrangement (including shape and characteristic) of the heat-generating resistors 22*b*, this embodiment will be described specifically together with Comparative Embodiments 1 and 2. Incidentally, in each of the embodiments, an alumina substrate of 8.75 mm in width, 270 mm in length and 1 mm in thickness was used.

1) Comparative Embodiment 1

Figure 5:
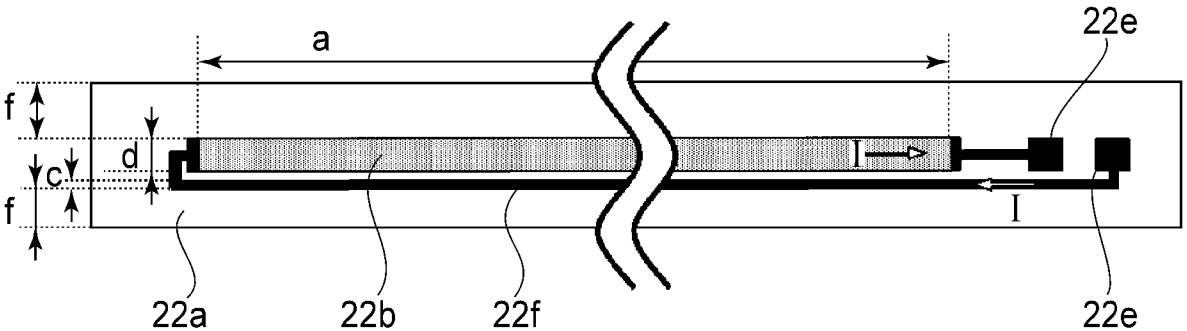
FIGS. 5 and 6 are enlarged plan views of heaters in Comparative Embodiments 1 and 2, respectively.

FIG. 5 shows a heater shape in Comparative Embodiment 1. The heat-generating resistor 22*b* in Comparative Embodiment 1 was formed by screen-printing, on the alumina substrate 22*a*, conventional paste prepared by kneading silver/palladium (Ag/Pd) as the electroconductive component with the glass powder (inorganic binder) and the organic binder. In Comparative Embodiment 1, a single heat-generating resistor 22*b* is used. The heat-generating resistor 22*b* was 225 mm in longitudinal length a, 2.0 mm in widthwise direction d and about 15 μm in thickness.

The electroconductive pattern 22*f* was 0.5 mm in width c. Each of the width c and a distance f is a minimum allowable value in manufacturing. The distance f from an end of the substrate 22*a* to the electroconductive pattern 22*f* is required to be about 0.7 mm in manufacturing but in Comparative Embodiment 1, the distance f is about 2.9 mm and thus is sufficient. In Comparative Embodiment 1, the sheet-resistance value of the heat-generating resistor 22*b* was about 0.22 Ω/sq, so that a total resistance (between the electric-power-supplying electrodes) of the heat-generating resistor 22*b* at normal temperature was about 16.5Ω. Further, an average change rate HOT-TCR of resistance values in a temperature range of 25° C. to 125° C. was +895 ppm/° C., so that the heat-generating resistor 22*b* showed the PTC characteristic.

When the electric power is supplied to the electric-power-supplying electrodes 22*e*, a current I passes through the heat-generating resistor 22*b* and the electroconductive pattern 22*f* in arrow directions shown in FIG. 5. That is, in the heat-generating resistor 22*b*, the current I passes through the substrate 22*a* in the longitudinal direction.

2) Comparative Embodiment 2

Figure 6:
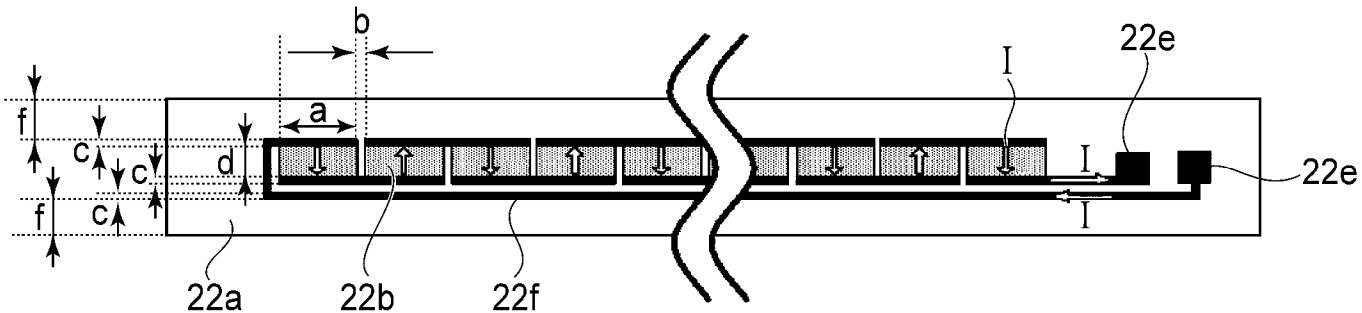

FIG. 6 shows a heater shape in Comparative Embodiment 2. In Comparative Embodiment 2, a single heat-generating-resistor train in which 41 heat-generating resistors are equidistantly arranged in the longitudinal direction. A distance b between adjacent heat-generating resistors constituting the heat-generating-resistor train was 0.5 mm. Further, each heat-generating resistor 22*b* was 5.0 mm in longitudinal length a and 2.0 mm in widthwise direction d, thus being formed in the same shape.

Therefore, the full length of the heat-generating-resistor train is 225 mm (including the distance (spacing) b) and is substantially same as that in Comparative Embodiment 1. The thickness of the heat-generating resistors 22*b* was about 15 μm, thus being equal to that in Comparative Embodiment 1. The divided electroconductive patterns 22*f* was 0.5 mm in width c. Each of the distance b and the width c is a minimum allowable value in manufacturing. A distance f from an end of the substrate 22*a* to the electroconductive pattern 22*f* is required to be about 0.7 mm in manufacturing but in Comparative Embodiment 2, the distance f is about 2.4 mm and thus is sufficient.

The respective heat-generating resistors 22*b* are electrically connected in series. Therefore, when the electric power is supplied to the electric-power-supplying electrodes 22*e*, a current I passes through the heat-generating resistor 22*b* and the electroconductive pattern 22*f* in arrow directions shown in FIG. 6. In each of the heat-generating resistors 22*b* constituting the heat-generating-resistor train, the electric power is supplied in the conveyance direction of the recording material P (hereinafter referred to as conveyance direction electric power supply). That is, in each of the heat-generating resistors 22*b*, the current I passes through the substrate 22*a* in the widthwise direction.

As the material for the heat-generating resistors 22*b*, ruthenium oxide ($RuO_2$) and silver/palladium (Ag/Pb) were used as the principal electroconductive component. The adjustment of the TCR and specific resistance of the heat-generating resistors 22*b* was made so that the total resistance (between the electric-power-supplying electrodes) of the heat-generating resistors 22*b* at normal temperature was about 16.5Ω. As a result, the average change rate HOT-TCR in the temperature range of 25° C. to 125° C. was about −145 ppm/° C. Further, the sheet-resistance value of the heat-generating resistors 22*b* was about 1.5 Ω/sq.

3) This Embodiment (First Embodiment)

Figure 1:
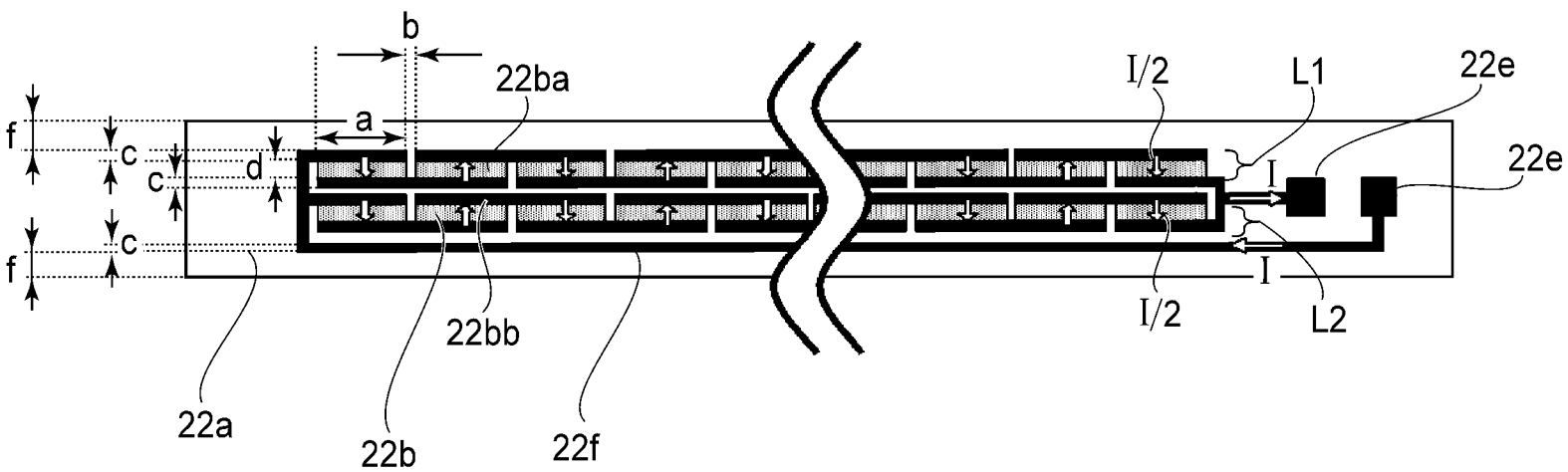
FIG. 1 is an enlarged plan view of a heater in a First Embodiment of the present invention.

FIG. 1 shows a heater arrangement in this embodiment. In this embodiment, two parallel heat-generating-resistor trains (L1 and L2) each including 41 heat-generating resistors 22*b* disposed equidistantly arranged in the longitudinal direction are formed. That is, 82 heat-generating resistors 22*b* in total are formed on the substrate 22*a*. A distance b between adjacent heat-generating resistors 22*b* constituting each heat-generating-resistor train was 0.5 mm. Each of the heat-generating resistors 22*b* is 5.0 mm in longitudinal length a, 1.0 mm in widthwise length d, thus having the same shape.

Therefore, the full length of the heat-generating-resistor train is about 225 mm (including the distance (spacing) b) and is substantially same as those in Comparative Embodiments 1 and 2. The thickness of the heat-generating resistors 22*b* was about 15 μm, thus being equal to that in Comparative Embodiment 1. Further, the total area of the heat-generating resistors 22*b* is substantially the same as that of the heat-generating resistors 22*b* in Comparative Embodiment 2. The divided electroconductive patterns 22*f* was 0.5 mm in width c. Each of the distance b and the width c is a minimum allowable value in manufacturing. A distance f from an end of the substrate 22*a* to the electroconductive pattern 22*f* is required to be about 0.7 mm in manufacturing but in this embodiment, the distance f is about 1.6 mm and thus is sufficient.

The respective heat-generating resistors 22*b* are electrically connected in series. Further, the two parallel heat-generating-resistor trains are electrically connected in parallel. Therefore, when the electric power is supplied to the electric-power-supplying electrodes 22*e*, a current I passes through the heat-generating resistor 22*b* and the electroconductive pattern 22*f* in arrow directions shown in FIG. 1. That is, in each of the heat-generating resistors 22*b* constituting the heat-generating-resistor trains, the current I passes through the substrate 22*a* in the widthwise direction in a conveyance-direction, electric-power-supply manner. Further, the two parallel heat-generating-resistor trains are electrically connected to each other in parallel and therefore a value of the current I passing through each heat-generating resistor 22*b* is I/2. Incidentally, the heater generates heat by the electric power supplied from a commercial AC power source. Therefore, an AC current passes through the heater (heat-generating resistors). The directions of the current shown in FIG. 1 are those with respect to one direction of the AC current.

Thus, the heater in this embodiment includes the elongated substrate 22*a*, and a first heat generating line (first heat-generating-resistor train) L1 and a second heat generating line (second heat-generating-resistor train) L2 which are provided along the longitudinal direction of the substrate 22*a*. As described above, the first and second heat generating lines L1 and L2 are electrically connected to each other in parallel.

The first heat generating line L1 includes a plurality of first heat-generating resistors 22*ba* having a negative temperature coefficient of resistance, and the plurality of first heat-generating resistors 22*ba* are electrically connected in series. Further, the second heat generating line L2 includes a plurality of second heat-generating resistors 22*bb* having a negative temperature coefficient of resistance, and the plurality of second heat-generating resistors 22*bb* are electrically connected in series.

Further, the first heat-generating resistors 22*ba* and the second heat-generating resistors 22*bb* have the same temperature coefficient of resistance.

Further, as shown in FIG. 1, the directions of the current passing through each of the first heat-generating resistors and each of the second heat-generating resistors are perpendicular to the longitudinal direction of the substrate.

Further, the direction of the current passing through one of the first heat-generating resistors is opposite to that of an adjacent one of the first heat-generating resistors with respect to the longitudinal direction of the substrate. The direction of the current passing through one of the second heat-generating resistors is opposite to that of an adjacent one of the second heat-generating resistors with respect to the longitudinal direction of the substrate.

As the material for the heat-generating resistors 22*b*, ruthenium oxide ($RuO_2$) and silver/palladium (Ag/Pb) were used as the principal electroconductive component. The adjustment of the TCR and specific resistance of the heat-generating resistors 22*b* was made so that the total resistance (between the electric-power-supplying) of the heat-generating resistors 22*b* at normal temperature was about 16.5Ω. As a result, the average change rate HOT-TCR in the temperature range of 25° C. to 125° C. was about −513 ppm/° C. Further, the sheet-resistance value of the heat-generating resistors 22*b* was about 6 Ω/sq.

(Comparison of TCR (Temperature Coefficient of Resistance) Values)

Here, with reference to FIGS. 16(*a*) to 16(*d*), the reason why the TCR value (about −513 ppm/° C.) in this embodiment is smaller than, i.e., larger in absolute value than, the TCR value (about −145 ppm/° C.) will be described. In this embodiment, the two parallel heat-generating-resistor trains are electrically connected in parallel.

Figure 16:
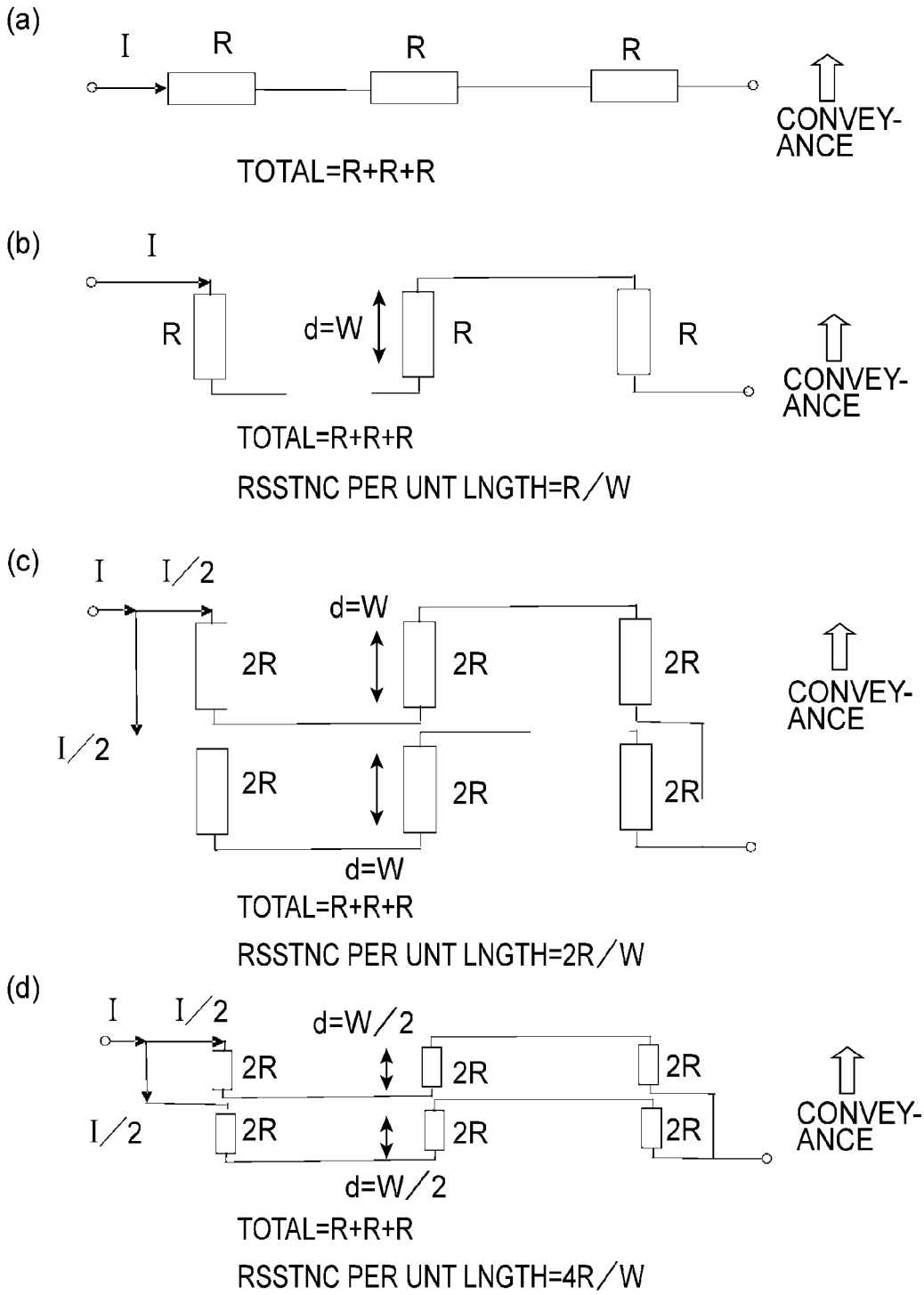
FIGS. 16(*a*) to 16(*d*) are schematic diagrams in the case of using three heat-generating resistors, in which FIG. 16(*a*) shows Comparative Embodiment 1, FIG. 16(*b*) shows Comparative Embodiment 2, FIG. 16(*c*) shows the case where a total width of the heat-generating resistors with respect to a paper-conveyance direction is 2d, and FIG. 16(*d*) shows the case where the total width of the heat-generating resistors with respect to the paper-conveyance direction is d.

For that reason, under the same condition with respect to the total resistance (between the electric-power-supplying electrodes) as in Comparative Embodiment 1 (FIG. 16(*a*)), compared with the resistance value in Comparative Embodiment 2 (FIG. 16(*b*), the resistance value of one of the two parallel heat-generating-resistor trains can be made two times (FIG. 16 (*c*)). That is, the specific resistance per unit length of each of the heat-generating resistors 22*b* with respect to the paper-conveyance direction can be made two times, i.e., 2R/W.

Although the arrangement shown in FIG. 16 (*c*) falls within the scope of the present invention, in order to realize substantially the same condition of the fixing property, the sum of the lengths d of the respective heat-generating resistors 22*b* with respect to the widthwise direction (conveyance direction) is W, which is the same as that in Comparative Embodiment 2.

In this embodiment, the widthwise length d of the respective heat-generating resistors 22*b* is W/2 (FIG. 16(*d*)) which is ½ of that in Comparative Embodiment 2 (FIG. 16(*b*)). That is, the specific resistance per unit length of each of the heat-generating resistors 22*b* with respect to the paper-conveyance direction is made two times, so that the specific resistance per unit length of each of the heat-generating resistors 22*b* with respect to the paper-conveyance direction can be made 4R/W, which is four times in total that (R/W) in Comparative Embodiment 2.

Here, when the resistance value at a temperature T0 is R0 and the resistance value at a temperature T1 is R1, the TCR value is represented by the following equation:

$$TCR=(R1-R0)/[(R0\times(T1-T0)]$$

That is, in the case where the heat-generating resistors have a negative temperature coefficient of resistance, the TCR value is proportional to a ratio (ΔR/R0) of an adjust ΔR of lowering in resistance to the specific resistance R0, e.g., when the temperature is increased from 25° C. to 125° C. With a larger specific resistance R0, the lowering amount ΔR becomes larger. However, when the specific resistance R0 becomes 4 times, e.g., by adjusting the amount of gloss surrounding ruthenium oxide ($RuO_2$), the lowering amount ΔR can be made larger than 4 times. As a result, the TCR value is increased.

Here, when the TCR value is further lowered, i.e., when the TCR value is further increased in terms of an absolute value, the specific resistance becomes large and thus the total resistance value is increased, so that the resultant resistance value is in a range in which the heater cannot be used by the commercial power source. In this embodiment, this problem is solved by electrically connecting the heat-generating-resistor trains in parallel. Incidentally, in this embodiment and Comparative Embodiments 1 and 2, the electric-power-supplying electrodes 22*e* are provided in the same side at one end portion of the substrate 22*a*, but may also be provided at both end portions of the substrate 22*a*.

(Comparison of Non-Sheet-Passing-Portion Temperature Rise)

Figure 7:
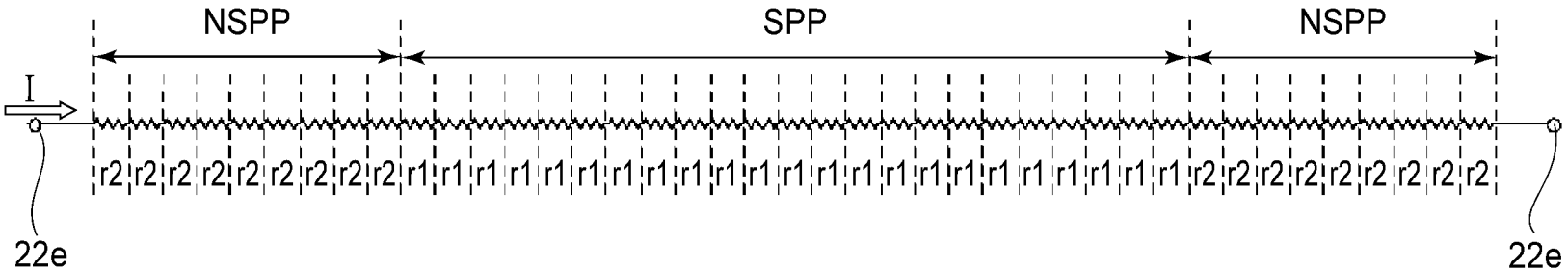
FIGS. 7 and 8 are schematic model views of the heaters in Comparative Embodiments 1 and 2, respectively.

Next, the non-sheet-passing-portion temperature rise will be described specifically. When the small-sized paper is passed through the image heating apparatus 6 including the heater in Comparative Embodiment 1, the above-described non-sheet-passing-portion temperature rise occurs conspicuously. Assuming that the heater in Comparative Embodiment 1 is mounted in the image heating apparatus 6 in this embodiment, the non-sheet-passing-portion temperature rise will be described with reference to a schematic model view. FIG. 7 is the schematic model view of the heat-generating resistors 22*b* in Comparative Embodiment 1. In this case, assuming that the heat-generating resistor 22*b* is divided into 41 heat-generating resistors with respect to its length direction and that a resistance of each of 23 heat-generating resistors at a central portion is r1 and a resistance of each of 18 heat-generating resistors at both end portions is r2, when the temperature is the same at the central portion and the both end portions, r1=r2 is satisfied.

In this case, the total resistance is (23×r1+18×r2) and is about 16.5Ω at normal temperature. When the current supplied to the heater is I, the amount of heat generating q1 at the central portion is $I^2\times r1$ and the amount of heat generating q2 at the end portions is $I^2\times r2$.

For easy understanding of explanation, assuming that a small-sized paper with a width of 23×L (=126.22 mm) is passed through the image heating apparatus 6, the central portion where the resistance is r1 is a sheet-passing portion ("SPP"), and each of the end portions where the resistance is r2 is a non-sheet-passing portion ("NSPP"). During a fixing process, temperature control such that energization (electric power supply) to the heat-generating resistors is controlled so that a detection temperature of the temperature detecting element 22*d* provided at the sheet-passing portion is kept at a target temperature is effected, so that the temperature of the non-sheet-passing portion where the heat is not absorbed by the small-sized paper is increased compared with the temperature of the sheet-passing portion where the heat is absorbed by the small-sized paper.

In Comparative Embodiment 1, the HOT-TCR (25° C. to 125° C.) of the heat-generating resistors 22*b* is about +895 ppm/° C., thus resulting in the PTC characteristic and therefore r1<r2 is satisfied during the sheet passing of the small-sized paper. The current I is the same between the sheet-passing portion and the non-sheet-passing portion and thus q1<q2, so that the amount of heat generation at the sheet-passing portion is larger than that at the non-sheet-passing portion.

Figure 8:
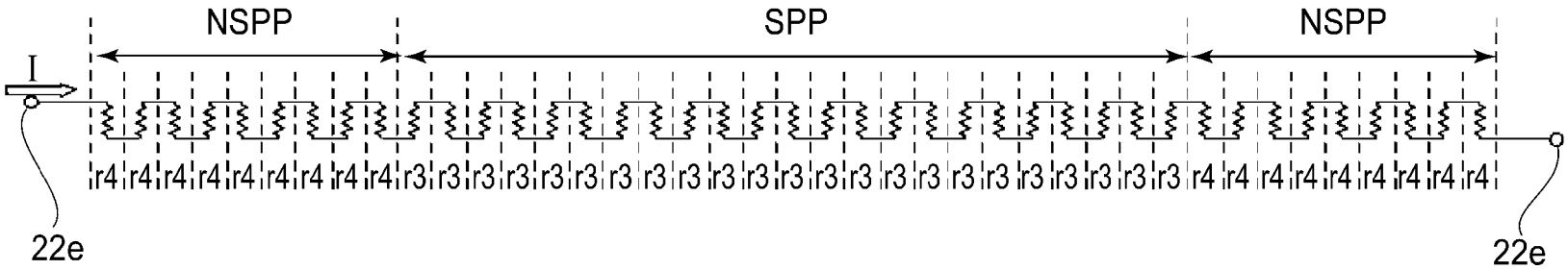

Similarly, the heater 22 in Comparative Embodiment 2 will be considered with reference to a schematic model view. FIG. 8 is the schematic model view of the heat-generating resistors 22*b* in Comparative Embodiment 2. Of the divided 41 heat-generating resistors, the resistance of each of 23 heat-generating resistors at the central portion is r3 and the resistance of each of 18 heat-generating resistors at the both end portions is r4. When the temperature is the same at the central portion and the both end portions, r3=r4 is satisfied.

In this case, the total resistance is (23×r3+18×r4) and is about 16.5Ω at normal temperature.

Therefore, in a state in which no sheet passing is made, when the temperature of the heat-generating resistors in the First Embodiment and the Comparative Embodiment 2 is the same, r1=r2=r3=r4 are satisfied. When the current supplied to the heater is I, the amount of heat generating q3 at the central portion is $I^2\times r3$ and the amount of heat generating q4 at the end portions is $I^2\times r4$.

Similarly as in the case of the heater in the Comparative Embodiment 1, assuming that the small-sized paper with a width of 23×L (=126.22 mm) is passed through the image heating apparatus 6, the central portion where the resistance is r3 is a sheet-passing portion ("SPP"), and each of the end portions where the resistance is r4 is a non-sheet-passing portion ("NSPP"). Also with respect to the heater in the Comparative Embodiment 2, similarly as in the case of the heater in the Comparative Embodiment 1, when the small-sized paper is passed through the heater, the temperature of the non-sheet-passing portion is increased compared with the temperature of the sheet-passing portion.

In the Comparative Embodiment 2, the HOT-TCR (25° C. to 125° C.) of the heat-generating resistors 22*b* is about −145 ppm/° C., thus resulting in the PTC characteristic and therefore r3>r4 is satisfied during the sheet passing of the small-sized paper. The current passing through each of the heat-generating resistors 22*b* is the same between the sheet-passing portion and the non-sheet-passing portion and thus q3>q4, so that the amount of heat generation at the sheet-passing portion is smaller than that at the non-sheet-passing portion in Comparative Embodiment 2.

Figure 9:
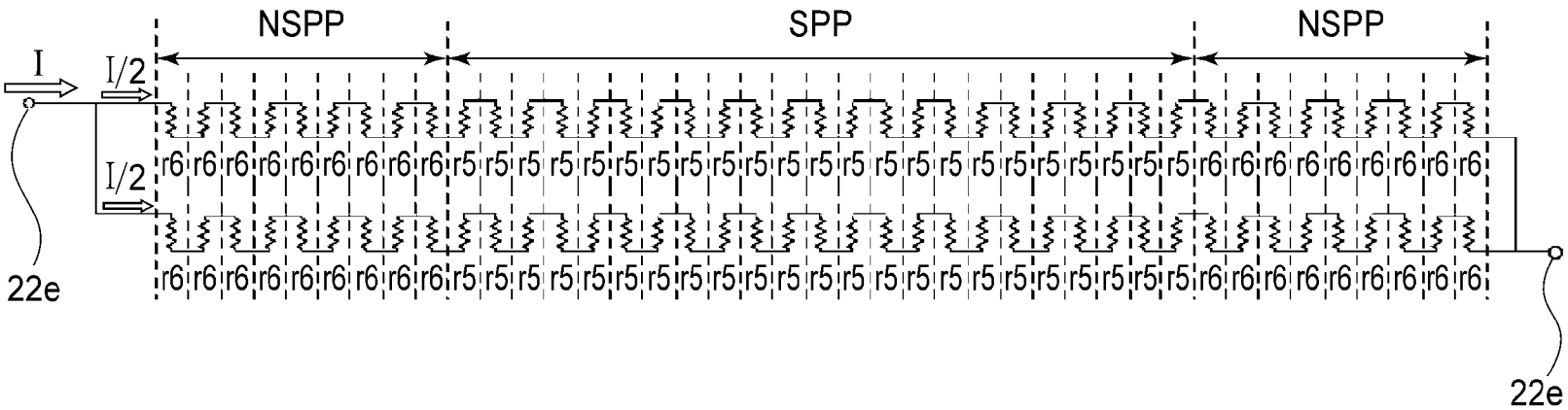
FIG. 9 is a schematic model view of the heater in the First Embodiment.

Similarly, the heater 22 in this embodiment (First Embodiment) will be considered with reference to a schematic model view. FIG. 9 is the schematic model view of the heat-generating resistors 22*b* in this embodiment. Of the divided 41 heat-generating resistors, a resistance of each of 23 heat-generating resistors at the central portion is r5 and a resistance of each of 18 heat-generating resistors at the both end portions is r6. When the temperature is the same at the central portion and the both end portions, r5=r6 is satisfied. In this embodiment, the two parallel heat-generating-resistor trains are electrically connected in parallel and therefore, the total resistance is (23×r5+18×r6) and is about 16.5Ω at normal temperature.

Therefore, in a state in which no sheet passing is made, when the temperature of the heat-generating resistors in the First Embodiment and Comparative Embodiment 2 is the same, r1=r2=r3=r4=r5/2=r6/2 are satisfied. When the current supplied to the heater is I, the value of the current passing through each of the heat-generating-resistor train is I/2 and thus an amount of heat generating q5 at the central portion is $(I/2)^2 \times r5 \times 2$ and an amount of heat generating q4 at the end portions is $(I/2)^2 \times r6 \times 2$.

Similarly as in the case of the heaters in Comparative Embodiments 1 and 2, assuming that the small-sized paper with a width of 23×L (=126.22 mm) is passed through the image heating apparatus 6, the central portion where the resistance is r5 is a sheet-passing portion ("SPP"), and each of the end portions where the resistance is r6 is a non-sheet-passing portion ("NSPP"). Also with respect to the heater in this embodiment, similarly as in the case of the heaters in Comparative Embodiments 1 and 2, when the small-sized paper is passed through the heater, the temperature of the non-sheet-passing portion is increased compared with the temperature of the sheet-passing portion.

In this embodiment, the HOT-TCR (25° C. to 125° C.) of the heat-generating resistors 22*b* is about −513 ppm/° C., thus resulting in the PTC characteristic and therefore r5>r6 is satisfied during the sheet passing of the small-sized paper. The current passing through each of the heat-generating resistors 22*b* is the same between the sheet-passing portion and the non-sheet-passing portion and thus q5>q6, so that the amount of heat generation at the sheet-passing portion is smaller than that at the non-sheet-passing portion also in this embodiment similarly as in Comparative Embodiment 2.

In Comparative Embodiments 1 and 2 and this embodiment, the total width of the heat-generating resistors of the heater is substantially the same, so that the fixing property is also substantially the same. Therefore, the amounts of heat generation (fixing property) at the sheet-passing portion when the small-sized paper is passed through the heater satisfy q2>q4 and q2>q6. Further, the HOT-TCR (25° C. to 125° C.) in Comparative Embodiment 2 is about −145 ppm/° C. and the HOT-TCR (25° C. to 125° C.) is about −513 ppm/° C., so that the resistance lowering at the non-sheet-passing portion in this embodiment is larger than that in Comparative Embodiment 2. Therefore, q4>q6 is satisfied.

Incidentally, in this embodiment, as shown in FIG. 9, an effect of preventing the non-sheet-passing-portion temperature rise is described by taking, as an example, the case of the small-sized paper with a paper end (edge) which coincides with the spacing (length b portion) between adjacent heat-generating resistors but the degree of the non-sheet-passing-portion temperature rise can be reduced also with respect to a small-sized paper with a paper end which does not coincide with the spacing between adjacent heat-generating resistors.

Comparative Experiment

Next, a comparative experiment using the heaters in Comparative Embodiments 1 and 2 and this embodiment (First Embodiment) will be described. The constitutions of the image heating apparatus and the image forming apparatus in Comparative Embodiments 1 and 2 and this embodiment are the same except for the constitutions of the heaters. When 100 sheets of a postcard-sized recording material were continuously passed through the image heating apparatus from a state in which the image heating apparatus was sufficiently kept at room temperature (23° C.), the temperature of the non-sheet-passing portion (measured by a thermo-couple at the back surface of the heater) was compared. A target fixing temperature was 200° C., and an input voltage was 100 V. Further, the process speed of the image forming apparatus was 120 mm/sec. The result is shown in Table 1.

TABLE 1

| Emb. No. | Temperature |
|---|---|
| Comp. Emb. 1 | 310° C. |
| Comp. Emb. 2 | 275° C. |
| Emb. 1 | 255° C. |

As shown in Table 1, the non-sheet-passing portion T in Comparative Embodiment 2 is lower than that in Comparative Embodiment 1. Further, in this embodiment, the non-sheet-passing portion T was considerably made lower than that in Comparative Embodiment 2.

According to this embodiment described above, it is possible to provide the heater using the heat-generating resistors which have the resistance value in the range in which the heater can be used by the commercial power source and which have the NTC characteristic such that the absolute value of the temperature coefficient of resistance (TCR value) is large. Further, it is possible to provide the image heating apparatus capable of suppressing the non-sheet-passing-portion temperature rise at low cost and with a simple structure.

Second Embodiment

The Second Embodiment of the present invention will be described with reference to the drawings below. A difference from the First Embodiment is only that different heat-generating resistors of the heater and a different electroconductive pattern are used. Other constitutions of the heater, the image heating apparatus and the image forming apparatus are the same as those in the First Embodiment. In the First Embodiment, the two parallel heat-generating-resistor trains were electrically connected in parallel to make the specific resistance (FIG. 16(*d*)) of the heat-generating resistors larger by 4 times than the specific resistance (FIG. 16(*b*)) of the heat-generating resistors, thus enabling the lowering in TCR value. Therefore, in order to further increase the specific resistance to lower the TCR value, the number of the heat-generating-resistor trains to be electrically connected in parallel may only be required to be increased.

Figure 10:
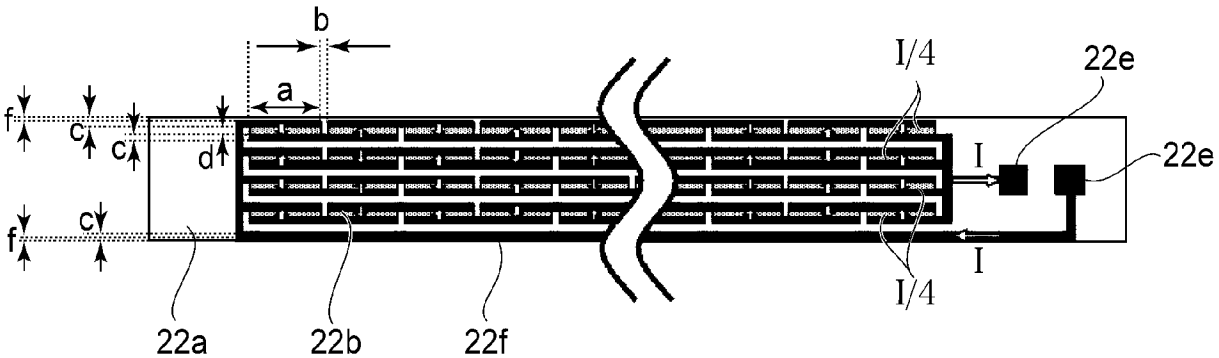
FIG. 10 is an enlarged plan view of a heater for comparison in a Second Embodiment.

FIG. 10 shows a heater in the case where four parallel heat-generating-resistor trains are electrically connected in parallel. The four heat-generating-resistor trains each including 42 heat-generating resistors 22*b*, which are arranged equidistantly in the longitudinal direction, are formed on the substrate 22*a*. That is, 168 heat-generating resistors 22*b* in total are formed on the substrate 22*a*. A distance b between adjacent heat-generating resistors 22*b* constituting each heat-generating-resistor train was 0.5 mm. Each of the heat-generating resistors 22*b* is 5.0 mm in longitudinal length a, 0.5 mm in widthwise length d, thus having the same shape. The thickness of the heat-generating resistors 22*b* was about 15

μm, thus being equal to that in the First Embodiment. Further, the total area of the heat-generating resistors 22*b* is substantially the same as that of the heat-generating resistors 22*b* in the First Embodiment. The divided electroconductive patterns 22*f* was 0.5 mm in width c. Each of the distance b and the width c is a minimum allowable value in manufacturing. Therefore, the full length of each heat-generating-resistor train is 225 mm (including the spacing b between adjacent heat-generating resistors), thus being substantially same as that in the First Embodiment. The sum of the lengths d of the heat-generating resistors 22*b* is also the same as in the First Embodiment, thus resulting in substantially the same condition for the fixing property. However, a distance f from the substrate end to the electroconductive pattern 22*f* is about 0.1 mm, thus resulting in the value less than about 0.7 mm required in manufacturing. In order to increase the value of the distance f, the heater substrate width may be increased but results in a large-sized image heating apparatus and a large-sized image forming apparatus and also results in an increase in cost.

Figure 11:
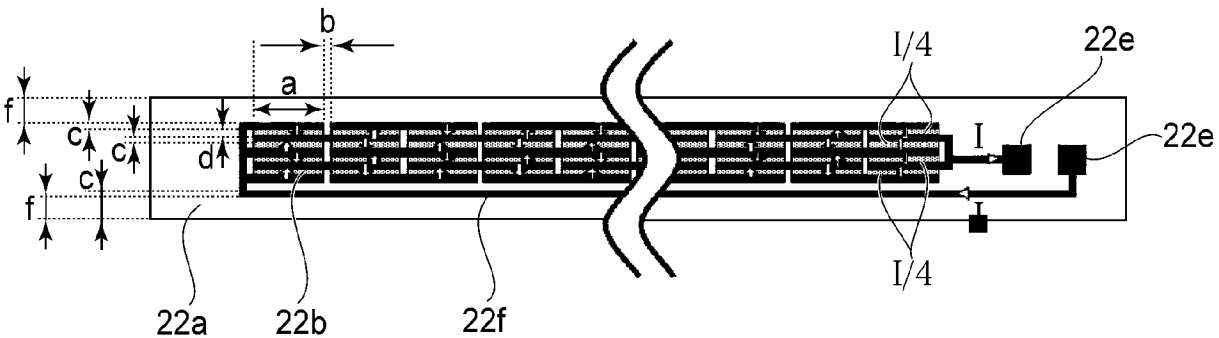
FIG. 11 is an enlarged plan view of a heater in the Second Embodiment.

Therefore, in this embodiment, a method is proposed in which an appropriate electroconductive pattern is formed and the heat-generating resistors in a large number to the extent possible are electrically connected in parallel with a narrow heat substrate width. FIG. 11 shows the heat-generating resistors and electroconductive pattern in the case where four parallel heat-generating-resistor trains in this embodiment are arranged. The four heat-generating-resistor trains each including 42 heat-generating resistors 22*b* which are arranged equidistantly in the longitudinal direction are formed on the substrate 22*a*. That is, 168 heat-generating resistors 22*b* in total are formed on the substrate 22*a*. A distance b between adjacent heat-generating resistors 22*b* constituting each heat-generating-resistor train was 0.5 mm. Each of the heat-generating resistors 22*b* is 5.0 mm in longitudinal length a, 0.5 mm in widthwise length d, thus having the same shape. The thickness of the heat-generating resistors 22*b* was about 15 μm, thus being equal to that in the First Embodiment. Further, a total area of the heat-generating resistors 22*b* are substantially the same as that of the heat-generating resistors 22*b* in the First Embodiment. The divided electroconductive patterns 22*f* was 0.5 mm in width c. Each of the distance b and the width c is a minimum allowable value in manufacturing. Therefore, the full length of each heat-generating-resistor train is 225 mm (including the spacing b between adjacent heat-generating resistors), thus being substantially same as that in the First Embodiment. The sum of the lengths d of the heat-generating resistors 22*b* is also the same as in the First Embodiment, thus resulting in substantially the same condition for the fixing property. Further, a distance f from the substrate end to the electroconductive pattern 22*f* is about 1.6 mm, thus sufficiently satisfying the condition of about 0.7 mm required in manufacturing.

Figure 12:
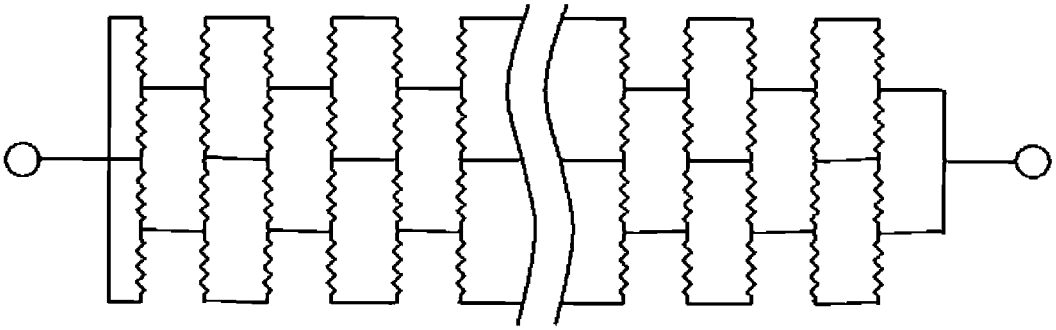
FIG. 12 is a schematic model view of the heater having a common electroconductive pattern in the Second Embodiment.
Figure 13:
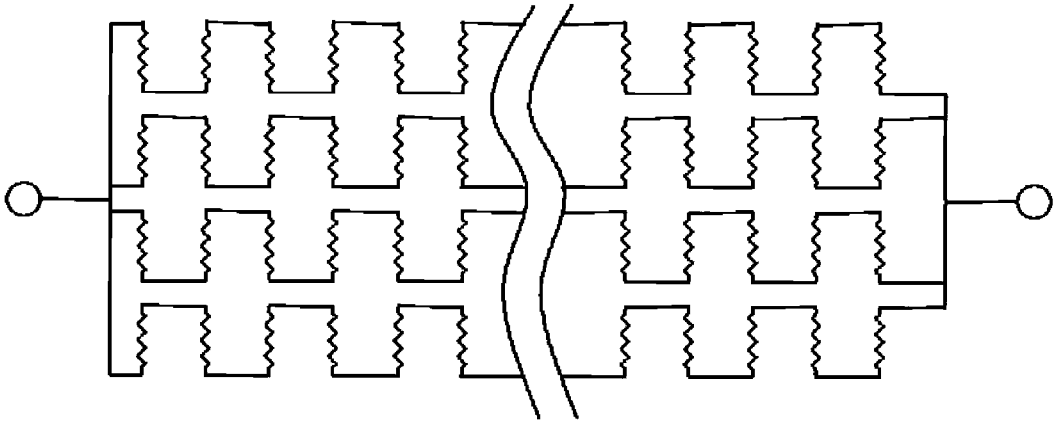
FIG. 13 is a schematic model view of the heater having a separated electroconductive pattern in the Second Embodiment.

As shown in FIG. 11, a characteristic feature of this embodiment is that the electroconductive pattern between adjacent heat-generating resistors 22*b* with respect to the widthwise direction is common to these adjacent heat-generating resistors 22*b*. FIG. 12 is a schematic model view of the heat-generating resistors 22*b* in the case where the electroconductive pattern is made common to the adjacent heat-generating resistors 22*b* with respect to the widthwise direction as described above. In view of symmetry of the circuit, the wiring portions indicated by broken lines in FIG. 12 are not common to the widthwise adjacent heat-generating resistors, but may also be separated from the widthwise adjacent wiring portion. The circuit view of FIG. 12 corresponds to that the heater shown in FIG. 11, and a circuit view of FIG. 13 corresponds to that of the heater shown in FIG. 10.

This constitution is equivalent to a constitution in which the respective heat-generating resistors 22*b* are electrically connected in series and the four parallel heat-generating-resistor trains are electrically connected in parallel. Therefore, when the electric power is supplied to the electric-power-supplying electrodes 22*e*, a current I passes through the heat-generating resistor 22*b* and the electroconductive pattern 22*f* in the arrow directions shown in FIG. 1, and in each of the heat-generating resistors 22*b* constituting the heat-generating-resistor trains, the current I passes through the substrate 22*a* in the widthwise direction in the conveyance-direction, electric-power-supply manner. Further, the two parallel heat-generating-resistor trains are electrically connected to each other in parallel and therefore a value of the current I passing through each heat-generating resistor 22*b* is I/4.

As the material for the heat-generating resistors 22*b*, ruthenium oxide ($RuO_2$) and silver/palladium (Ag/Pb) were used as the principal electroconductive component. The adjustment of the TCR and specific resistance of the heat-generating resistors 22*b* was made so that the total resistance (between the electric-power-supplying electrodes) of the heat-generating resistors 22*b* at normal temperature was about 16.5Ω. As a result, the average change rate HOT-TCR in the temperature range of 25° C. to 125° C. was about −696 ppm/° C., thus resulting in a value which is further smaller than that in the First Embodiment. Further, the sheet-resistance value of the heat-generating resistors 22*b* was about 24 Ω/sq.

Next, an experiment using the heater in this embodiment will be described. The constitutions of the image heating apparatus and the image forming apparatus also in this embodiment are the same as those in the First Embodiment except for the constitutions of the heaters. Thus, when 100 sheets of a postcard-sized recording material were continuously passed through the image heating apparatus from a state in which the image heating apparatus was sufficiently kept at room temperature (23° C.), the temperature of the non-sheet-passing portion (measured by a thermo-couple at the back surface of the heater) was compared. The target fixing temperature was 200° C., and the input voltage was 100 V. Further, the process speed of the image forming apparatus was 120 mm/sec. As a result, the non-sheet-passing-portion temperature was 240° C., so that the non-sheet-passing-portion temperature was capable of being further lowered compared with the First Embodiment.

In this embodiment, the case where the number of the heat-generating-resistor trains is four is described, but the present invention is not limited thereto and may also use two or more arranged heat-generating-resistor trains. When the number of the heat-generating-resistor trains is made the maximum number of the heat-generating resistors that can be formed on the substrate, it is possible to use a material having the highest sheet-resistance value, and thus the use of the material is desirable from the viewpoint of suppressing the non-sheet-passing-portion temperature rise.

Figure 14:
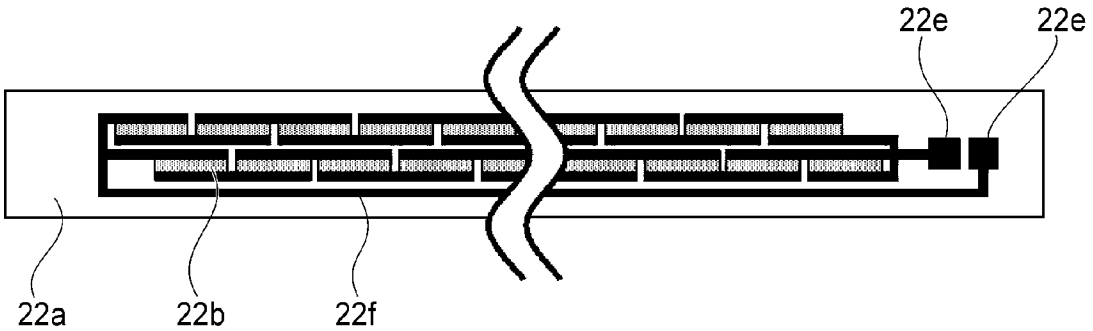
FIGS. 14 and 15 are schematic sectional structural views of other heaters in the First and Second Embodiments, respectively.

Further, when the spacing between adjacent heat-generating resistors constituting each heat-generating-resistor train is increased, there is a possibility that the fixing property at that portion deteriorates. In such a case, this possibility can be avoided by shifting positions of the respective heat-generating-resistor trains from each other with respect to the longitudinal direction. FIG. 14 shows the case where the heat-generating-resistor trains in the heater pattern described in the First Embodiment are shifted in the longitudinal direction.

Figure 15:
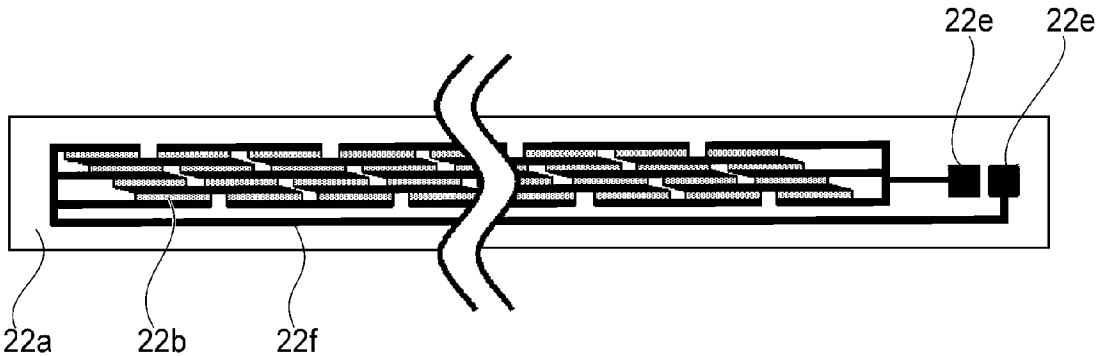

Further, FIG. 15 shows the case where the heat-generating-resistor trains in the heater pattern described in the Second Embodiment are shifted in the longitudinal direction. In each of FIGS. 14 and 15, the spacings between the adjacent heat-generating resistors constituting each heat-generating-resistor train are shifted from those constituting the widthwise adjacent heat-generating-resistor train, and therefore over the entire longitudinal direction, there is no region where the heat-generating resistors are not present, so that it becomes possible to ensure a better fixing property.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 124161/2011 filed Jun. 2, 2011, which is hereby incorporated by reference.

What is claimed is:

1. An image heating apparatus comprising:

an endless belt;

a heater contacting an inner surface of said endless belt, wherein said heater is provided so that a longitudinal direction thereof is parallel to a generatrix direction of said endless belt; and a pressing member configured to form a nip, in which a recording material carrying thereon an image is to be nip conveyed, together with said endless belt, wherein said heater comprises:

an elongated substrate;

a first heat generating line provided on said substrate along a longitudinal direction of said substrate, wherein said first heat generating line includes a first heat generating resistor having a negative temperature coefficient of resistance; and a second heat generating line, provided on said substrate along the longitudinal direction of said substrate, electrically connected to said first heat generating line in parallel, wherein said second heat generating line includes a second heat generating resistor having the negative temperature coefficient of resistance.

2. An apparatus according to claim 1, wherein the first heat generating resistor and the second heat generating resistor have the same value of the temperature coefficient of resistance.

3. An apparatus according to claim 1, wherein a direction of a current passing through the first heat generating resistor and the second heat generating resistor is perpendicular to the longitudinal direction.

4. A heater for use with an image heating apparatus comprises:

an elongated substrate;

a first heat generating line provided on said substrate along a longitudinal direction of said substrate, wherein said first heat generating line includes a first heat generating resistor having a negative temperature coefficient of resistance; and a second heat generating line, provided on said substrate along the longitudinal direction of said substrate, and electrically connected to said first heat generating line in parallel, wherein said second heat generating line includes a second heat generating resistor having the negative temperature coefficient of resistance.

5. A heater according to claim 4, wherein the first heat generating resistor and the second heat generating resistor have the same value of the temperature coefficient of resistance.

6. A heater according to claim 4, wherein a direction of a current passing through the first heat generating resistor and the second heat generating resistor is perpendicular to the longitudinal direction.

7. An image heating apparatus comprising:

an endless belt;

a heater contacting an inner surface of said endless belt, wherein said heater is provided so that a longitudinal direction thereof is parallel to a generatrix direction of said endless belt; and a pressing member configured to form a nip, in which a recording material carrying thereon an image is to be nip conveyed, together with said endless belt, wherein said heater comprises:

an elongated substrate;

a first heat generating resistor provided on said substrate along a longitudinal direction of said substrate, wherein said first heat generating has a negative temperature coefficient of resistance; and a second heat generating resistor, provided on said substrate along the longitudinal direction of said substrate at a position different from that of said first heat generating resistor in a direction perpendicular to the longitudinal direction, electrically connected to said first heat generating resistor in parallel, wherein said second heat generating resistor has the negative temperature coefficient of resistance, wherein an electroconductive pattern of the first heat generating resistor is equivalent to an electroconductive pattern of the second heat generating resistor.

8. An apparatus according to claim 7, wherein the first heat generating resistor and the second heat generating resistor have the same value of the temperature coefficient of resistance.

9. An apparatus according to claim 7, wherein a direction of a current passing through the first heat generating resistor and the second heat generating resistor is perpendicular to the longitudinal direction.

10. A heater for use with an image heating apparatus comprises:

an elongated substrate;

a first heat generating resistor provided on said substrate along a longitudinal direction of said substrate, wherein said first heat generating has a negative temperature coefficient of resistance; and a second heat generating resistor, provided on said substrate along the longitudinal direction of said substrate at a position different from that of said first heat generating resistor in a direction perpendicular to the longitudinal direction, electrically connected to said first heat generating resistor in parallel, wherein said second heat generating resistor has the negative temperature coefficient of resistance, wherein an electroconductive pattern of the first heat generating resistor is equivalent to an electroconductive pattern of the second heat generating resistor.

11. An apparatus according to claim 10, wherein the first heat generating resistor and the second heat generating resistor have the same value of the temperature coefficient of resistance.

12. An apparatus according to claim 10, wherein a direction of a current passing through the first heat generating resistor and the second heat generating resistor is perpendicular to the longitudinal direction.

13. An image heating apparatus comprising:

an endless belt;

a heater contacting an inner surface of said endless belt, wherein said heater is provided so that a longitudinal direction thereof is parallel to a generating line direction of said endless belt; and a pressing member configured to form a nip, in which a recording material carrying thereon an image is to be nip conveyed, together with said endless belt, wherein said heater comprises:

an elongated substrate;

a plurality of first heat generating resistors provided on said substrate along a longitudinal direction of said substrate, wherein said first heat generating resistors have a negative temperature coefficient of resistance, and a direction of a current passing through each of said first heat generating resistors is perpendicular to the longitudinal direction of said substrate, and wherein the plurality of first heat generating resistors are electrically connected in series; and a plurality of second heat generating resistors provided on said substrate along a longitudinal direction of said substrate, wherein said second heat generating resistors have a negative temperature coefficient of resistance, and a direction of a current passing through each of said second heat generating resistors is perpendicular to the longitudinal direction of said substrate, and wherein the plurality of second heat generating resistors are electrically connected in series, wherein the plurality of first heat generating resistors and the plurality of second heat generating resistors are electrically connected in parallel, and wherein edges of each of the first heat generating resistors in the longitudinal direction and edges of each of the second heat generating resistors in the longitudinal direction are positioned at the same position with respect to the longitudinal direction.

14. An apparatus according to claim 13, wherein the first heat generating resistors and the second heat generating resistors have the same value of the temperature coefficient of resistance.

15. An apparatus according to claim 13, wherein the direction of the current passing through one of the first heat generating resistors is opposite to the direction of the current passing through an adjacent one of the first heat generating resistors with respect to the longitudinal direction, and the direction of the current passing through one of the second heat generating resistors is opposite to the direction of the current passing through an adjacent one of the second heat generating resistors with respect to the longitudinal direction.

16. A heater for use with an image heating apparatus comprises:

an elongated substrate;

a plurality of first heat generating resistors provided on said substrate along a longitudinal direction of said substrate, wherein said first heat generating resistors have a negative temperature coefficient of resistance, and a direction of a current passing through each of said first heat generating resistors is perpendicular to the longitudinal direction of said substrate, and wherein the plurality of first heat generating resistors are electrically connected in series; and a plurality of second heat generating resistors provided on said substrate along a longitudinal direction of said substrate, wherein said second heat generating resistors have a negative temperature coefficient of resistance, and a direction of a current passing through each of said second heat generating resistors is perpendicular to the longitudinal direction of said substrate, and wherein the plurality of second heat generating resistors are electrically connected in series, wherein the plurality of first heat generating resistors and the plurality of second heat generating resistors are electrically connected in parallel, and wherein edges of each of the first heat generating resistors in the longitudinal direction and edges of each of the second heat generating resistors in the longitudinal direction are positioned at the same position with respect to the longitudinal direction.

17. A heater according to claim 16, wherein the first heat generating resistors and the second heat generating resistors have the same value of the temperature coefficient of resistance.

18. A heater according to claim 16, wherein the direction of the current passing through one of the first heat generating resistors is opposite to the direction of the current passing through an adjacent one of the first heat generating resistors with respect to the longitudinal direction, and the direction of the current passing through one of the second heat generating resistors is opposite to the direction of the current passing through an adjacent one of the second heat generating resistors with respect to the longitudinal direction.

* * * * *